US005484758A

United States Patent [19]

Wald

[11] Patent Number: 5,484,758

[45] Date of Patent: Jan. 16, 1996

[54] THERMALLY-SENSITIVE RECORD MATERIAL

[75] Inventor: Thomas S. Wald, Lincoln, England

[73] Assignee: The Wiggins Teape Group Limited, England

[21] Appl. No.: 314,709

[22] Filed: Sep. 29, 1994

[30] Foreign Application Priority Data

Oct. 2, 1993 [GB] United Kingdom ..... 9320341

[51] Int. Cl.[6] ..... B41M 5/30

[52] U.S. Cl. ..... 503/214; 427/150; 503/225

[58] Field of Search ..... 427/150; 503/214, 503/225

[56] References Cited

U.S. PATENT DOCUMENTS

| | | | |
|---|---|---|---|
| 4,032,690 | 6/1977 | Kohmura et al. | 428/263 |
| 4,966,883 | 10/1990 | Anderson et al. | 503/208 |

FOREIGN PATENT DOCUMENTS

| | | | |
|---|---|---|---|
| 211968B | 2/1990 | European Pat. Off. | 503/214 |
| 238709B | 7/1991 | European Pat. Off. | 503/214 |
| 0487350 | 5/1992 | European Pat. Off. | 428/195 |
| 52-73047 | 6/1977 | Japan | 503/214 |
| 54-1040 | 1/1979 | Japan | 503/214 |
| 54-80136 | 6/1979 | Japan | 503/214 |
| 55-7160 | 2/1980 | Japan | 503/214 |
| 55-156088 | 12/1980 | Japan | 503/214 |
| 57-46752 | 5/1982 | Japan | 503/214 |
| 58-89397 | 5/1983 | Japan | 503/214 |
| 1479542 | 7/1977 | United Kingdom | 503/214 |
| 2134664 | 8/1984 | United Kingdom | 503/214 |

OTHER PUBLICATIONS

"The Chemistry of 'Scripset' Resins", pp. 1–12.
"'Scripset' Resins 700 Series", pp. 1–9.
"'Scripset' 500 Resin".
"'Scripset' 520 Resin".
Material Safety Data Sheets, "Scripset" 500, 501.
Material Safety Data Sheets, "Scripset" 520.
Material Safety Data Sheets, "Scripset" 540.
Material Safety Data Sheets, "Scripset" 550.
Material Safety Data Sheets, "Scripset" 700.
"SMA Resins", Mar. 1989, pp. 2 and 3.

*Primary Examiner*—B. Hamilton Hess
*Attorney, Agent, or Firm*—Burns, Doane, Swecker & Mathis

[57] ABSTRACT

A binder formulation for improving the water resistance, especially the warm water resistance, of thermally-sensitive record material comprises a major proportion of an amide ammonium salt of a substantially non-esterified styrene/maleic anhydride copolymer and a minor proportion of polyvinyl alcohol.

3 Claims, No Drawings

THERMALLY-SENSITIVE RECORD MATERIAL

This invention relates to thermally-sensitive record material.

Thermally-sensitive record material is widely used in facsimile (telecopier) machines, labels, tickets, charts for recording the output of medical or scientific monitoring equipment and for the output of calculators, adding machines, small computer printers and such-like. In its most common form, the record material comprises a support carrying a coating of a thermally sensitive composition of which the image-forming components are one or more initially colorless or light-colored electron-donating chromogenic materials (or color formers) and one or more electron-accepting coreactants (or color developers) capable of reacting with the chromogenic material to develop its color. The electron-donating chromogenic material is normally a fluoran or other leucodye and the electron-accepting coreactant is normally an organic acid, most commonly a bisphenol.

The chromogenic material and the coreactant are normally each present in finely-divided particulate form and are dispersed in a suitable matrix material, for example polyvinyl alcohol, which also serves as a binder. The thermally-sensitive composition usually also contains a variety of other ingredients such as sensitizers or modifiers for enhancing the thermal response of the composition, fillers or pigments, lubricants, whiteners, image-stabilizers, and wetting aids.

The support is normally of paper, although plastic film is used for certain products, such as transparencies. The support can if desired be precoated, for example with a pigment/binder composition.

In their initial solid state, the chromogenic material and the coreactant do not react together. On selective imagewise application of heat by means of a thermal printer or stylus, local melting of one or more of the components of the thermally-sensitive composition occurs. The liquid phase thus created facilitates reaction between the chromogenic material and the coreactant, thereby developing the color of the chromogenic material in a pattern corresponding to that of the heat energy input, and so producing an image.

All of the foregoing is very well known and is the subject of an extensive patent literature, and so needs no further description.

Thermally-sensitive record material for certain end uses is required to be resistant to moisture. In particular, it must not rub off when wet, and must still be capable of being imaged after exposure to moisture, whether or not it has fully dried. Also, the thermally-sensitive coating must not become sticky, which might, for example, lead to problems in satisfactory unreeling of a coil of the record material. In use, heat generated by the thermal print head and its associated electrical circuitry can cause any moisture present to warm up. Also, the print head may be incorporated in a machine which stands in a hot environment. The thermally sensitive record material must therefore be able to withstand contact not just with cold water but with warm water.

Examples of thermally-sensitive record material products for which moisture resistance is important are labels for goods stored in the open or in a humid environment or for use in freezers, cold cabinets, refrigerators or the like; transportation, parking, entertainment or other tickets which may be exposed to rain or spillages after issue or to condensation whilst still in an issuing machine; and industrial recorders or process monitors which may be in exposed locations where condensation or moisture ingress is a problem.

We have conducted experiments with thermally sensitive record materials of the kind intended for conversion into products as just described, and have found that whilst certain of them are resistant to cold water (as measured by not smearing when wetted and rubbed with the finger), they are in general easily smeared when wetted with warm to hot water (60° C.). "Smearing" in this context means that the coating does not stay in its original position when rubbed with the finger, but moves with the finger as the finger slides over the thermally coated surface.

It is an object of the present invention to provide thermally sensitive record material with improved water resistance, particularly warm water resistance.

In attempting to modify thermally sensitive record material so as to improve its water resistance, it is important that the thermally sensitive record material should not lose the other characteristics desirable in such a product, for example good thermal sensitivity, a sharp initiation temperature, resistance to discoloration on storage (both before and after imaging), lack of adhesion to the thermal print head ("sticking"), avoidance of deposition of coating constituents on the print head ("residue"), and low abrasiveness with respect to the print head. The last mentioned property is particularly important with print heads which have heating elements without a protective coating and/or have exposed printed circuitry which could be damaged by continuous rubbing contact with the thermal coating.

One means of achieving the desired degree of water resistance is to employ a barrier topcoat over the thermally sensitive coating. Whilst such barrier topcoats can be very effective, they add significantly to the cost and manufacturing-complexity of the product.

An alternative approach has been to attempt to cross link water soluble binder material, for example polyvinyl alcohol, normally present in the thermally-sensitive coating, so as to render it water insoluble. We have found it difficult to achieve the desired degree of cross linking, with the result that although cold water resistance can be obtained, adequate hot water resistance cannot.

A further approach is to employ binder materials such as lattices which are intrinsically less water soluble than polyvinyl alcohol or other commonly used hydrophilic binders. We have found however that the use of lattices tends to give rise to markedly increased image fading, and often to other problems as well, for example sticking and residue. Latex-containing formulations also tend to be difficult to grind to a desirable final particle size.

Yet a further approach has been based on the use of various types of styrene/maleic anhydride copolymers. One such proposal is to be found in British Patent No. 1479542, which discloses the use of a water soluble binder containing a carboxyl group and having a softening point of 200° C. or higher for producing a thermally sensitive coating which is resistant to water and does not give rise to sticking, residue or abrasion of the thermal print head. The binder may be a sodium, ammonium, potassium or ethanolamine salt of styrene/maleic anhydride copolymers. However this patent is not specific to the use of styrene/maleic anhydride copolymers, carboxyl-modified starches and carboxy methyl celluloses being disclosed as suitable alternatives. There is also a general disclosure that it is "feasible" to use the specified carboxyl containing binders with other water soluble binders such as hydroxymethylcellulose, polyvinyl alcohol, gum arabic etc. Hydroxyethyl cellulose is present in certain Examples, but there is no specific disclosure of the use of styrene/maleic anhydride copolymer materials in combination with polyvinyl alcohol. British Patent No. 1479542 also discloses the use of an ammonium salt of a partial ester of styrene/maleic anhydride copolymer (with no other binder being present) in the context of a comparison experiment stated to be not within the scope of the invention of the patent. British Patent application No. 2134664A also makes general reference to the use of styrene-maleic anhydride copolymer salts as binders for use in thermally-sensitive coating compositions, but no special emphasis is placed on these copolymer salts compared with the numerous other possible binders also disclosed.

European Patent No. 238709B discloses the use, for the purpose of improving the water resistance of thermally sensitive record material, of an ammonium salt of diisobutylene/maleic anhydride copolymer of a specified general formula. In specific Examples, Polyvinyl alcohol is also present. The use of thermally sensitive coatings containing diisobutylene/maleic anhydride copolymer ammonium salt and polyvinyl alcohol is also disclosed in European Patent No. 211968B. Other disclosures of the use of diisobutylene/maleic anhydride copolymer are to be found in Japanese laid open patent publication Nos. 52-73047; 54-1040, 54-80136 and 58-89397. No. 54-1040 also discloses the use of a styrene/maleic anhydride copolymer, believed to be a sodium salt, in a comparison experiment.

We have now found that significant improvements in the warm water resistance of thermally sensitive record material can be achieved by the use of a binder combination which comprises a major proportion of an amide ammonium salt of a-substantially non-esterified styrene/maleic anhydride copolymer and a minor proportion of polyvinyl alcohol.

Accordingly the present invention provides in a first aspect a thermally-sensitive record material comprising a support and a thermally-sensitive composition coated on the support, the thermally-sensitive composition including as image forming components an electron donating chromogenic material and complementary electron accepting coreactant material effective to develop the color of the chromogenic material when heat is applied to the composition, said image forming components being dispersed in a thermographically acceptable binder formulation, characterized in that the binder formulation comprises a major proportion of an amide ammonium salt of a substantially non-esterified styrene/maleic anhydride copolymer and a minor proportion of polyvinyl alcohol.

In a second aspect, the present invention resides in the use, for the purpose of improving the water resistance, particularly the warm water resistance, of thermally sensitive record material including as image-forming components an electron donating chromogenic material and complementary electron accepting coreactant material effective to develop the color of the chromogenic material when heat is applied to the composition, of a binder formulation for said components comprising a major proportion of an amide ammonium salt of a substantially non-esterified styrene/maleic anhydride copolymer and a minor proportion of polyvinyl alcohol.

An amide ammonium salt of a non-esterified styrene/maleic anhydride copolymer is commercially available from Monsanto under the name "Scripset 720" ("Scripset" is a trade mark). Amide ammonium salts can be produced by reacting styrene/maleic anhydride copolymer with ammonium hydroxide to give compounds containing repeating units of the outline formula (I) below.

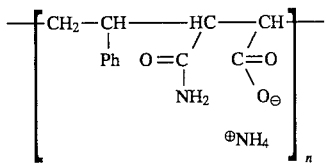

(I)

Such compounds are often referred to as half amide/half ammonium salts, but it will be appreciated that the amide and ammonium groups need not be present in exactly equal numbers.

In principle, an amide ammonium salt can be used in which the ammonium salt is only a partial rather than a full salt. In practice, however, such salts tend to have too high a viscosity to be readily usable. They can be produced by treating styrene/maleic anhydride copolymer with anhydrous ammonia to give compounds containing repeating units of the outline formula (II) below:

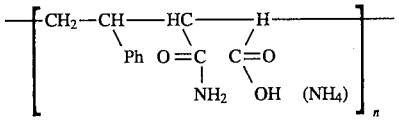

(II)

Ester ammonium salts (as opposed to amide ammonium salts) can be produced by esterifying styrene/maleic anhydride copolymer with a relatively low molecular weight alcohol and then neutralizing with ammonium hydroxide to give compounds containing repeating units of the outline formula (Ill) below:

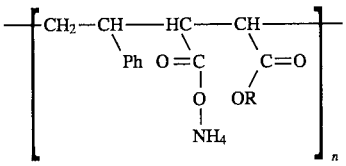

(III)

where R is the residue from the alcohol used for esterification.

We have found that although such ester ammonium salts are effective in imparting the desired water resistance, they give rise to sticking and residue problems when used in major proportion in binder formulations for thermally-sensitive papers. The use of ammonium salts of partial esters of styrene/maleic anhydride copolymers (but not together with polyvinyl alcohol) is disclosed in British Patent No. 1479542 already referred to (See Run No.7 of Table 1 and Example 7, where the "Scripset 520" product referred to is in fact a partial ester).

When determining the relative proportions of styrene/maleic anhydride copolymer salt and polyvinyl alcohol to be used in the binder formulation, it is important to have regard to the nature of the polyvinyl alcohol to be used. With typical polyvinyl alcohols as currently used in thermally-sensitive record materials (which have a degree of hydrolysis of the order of a little under 90%), the styrene/maleic anhydride copolymer salt should desirably make up at least about 80% by weight of the total binder used, preferably about 85% by weight. However, less than this can be used if the polyvinyl alcohol is more highly hydrolyzed or if glyoxal or another hardener is also used, for example 70 to 80% by weight. If both a highly hydrolyzed polyvinyl alcohol and a hardener are employed, then the amount of styrene/maleic anhydride copolymer can fall further, say to around 60% by weight, or even less, subject to the proviso that the styrene/maleic anhydride copolymer salt must be present in major proportion of the binder formulation. The residual minor proportion of the binder formulation need not be made up exclusively of polyvinyl alcohol. For example, the presence of a small proportion of latex, normally a styrene-butadiene latex, may be useful in certain circumstances. Also, relatively small amounts of ester ammonium salts as described above can be used in certain formulations, particularly those not containing oxygen-containing sensitizers such as diphenoxyethane, diphenyl carbonate, dibenzyl oxalate or dibenzyl terephthalate, as such small amounts do not generally give rise to significant sticking and residue problems.

The total binder content is typically of the same order as is conventional in thermally-sensitive record materials generally, i.e. of the order of 10 to 25% by weight.

The support used in the present thermally-sensitive record material is typically of paper, but plastics film could be used.

Whatever the nature of the support, it can if desired carry one or more precoats on its surface to which the thermally-sensitive composition is applied. Where the support is of paper, the precoat(s) can serve to improve the hold-out and smoothness of the support prior to the application of the thermal coating. Where the support is of plastics film, the precoat(s) can serve to provide a better bond or key to the film. Additionally, and regardless of the nature of the support, the precoat(s) can serve to improve absorptivity with respect to the subsequently-applied thermal composition, to lessen loss of imaging heat energy by dissipation into and through the support, to reduce sticking of the thermal composition to the printhead, to provide anti-static properties, or for other purposes.

In the case of a paper support at least, the precoat typically comprises one or more pigments and a binder.

The pigment(s) may be inorganic or organic, one or more of calcium carbonate, delaminated kaolin or calcined kaolin being preferred.

Typical chromogenic compounds for use in the thermally-sensitive composition are fluorans, particularly derivatives of 2, 6-diamino substituted fluorans, and phthalides, particularly, 3,3-bis(4'-dimethylaminophenyl)- 6-dimethylaminophthalide (Crystal Violet Lactone). Specific examples of commercially available fluorans which can be used are (with usual short names in brackets) 3-diethylamino-6-methyl-7-anilinofluoran (N-102); 3-dibutylamino-6-methyl-7-anilinofluoran (ODB-2); and 3-N-ethyl-N-isopentylamino-6-methyl-7-anilinofluoran (S205). Other possible chromogenic materials are those disclosed in our European Patent Application No. 343014A.

Typical coreactants for use in the composition are bisphenols such as 2,2-bis(4-hydroxyphenyl)-propane (Bisphenol A) and 2,2-bis(4-hydroxyphenyl)-4-methylpentane (hereafter referred to by its usual short name of AP-5), bisphenol sulphones such as bis(4-hydroxyphenyl)sulphone (Bisphenol S), aromatic carboxylic esters such as benzyl 4-hydroxybenzoate, and other coreactants conventional in the art, for example those disclosed in European Patent Application No. 306344A.

Sensitizers suitable for use in the thermally-sensitive composition are diaryl ethers such as diphenoxyethane, aryl- or aralkyl-substituted biphenyls such as parabenzylbiphenyl, acetoacetic anilides or toluidides, phenylhydroxynaphthoates, and aromatic diesters such as dimethyl or dibenzyl terephthalate and dibenzyl oxalate. These materials may be used together with modifiers such as stearamide waxes which also enhance the sensitivity of the thermal composition. Alternatively stearamide waxes such as ethylene his stearamide wax, can be used on their own.

Fillers or pigments which may be used in the thermally-sensitive composition are clays, for example delaminated or calcined kaolin, aluminum hydroxide, aluminum oxide, calcium carbonate, talc and zinc oxide. Such materials serve as extenders and whiteners/pacifiers, and, particularly when they have good oil absorption, reduce smudging of the thermal image and build up of the coating on the thermal printing head in use.

The thermally-sensitive composition may also contain optical brighteners, lubricants such as fatty acid salts, for example zinc stearate, to prevent sticking of the composition to the thermal printing head in use, and paraffin wax, which reduces any tendency of the chromogenic material to color up prematurely and thus improves background whiteness.

The thermally sensitive composition can be made up as conventional in the art. Thus, typically the co-reactant and the chromogenic material will be separately dispersed and bead milled in an aqueous medium containing one or both required constituents of the binder formulation. Bead milling, also known simply as grinding, is normally to a particle size in the range 1 to 10 μm or less. Sensitizer, if used, is generally included in the chromogenic material mixture or the coreactant material mixture, or both, prior to bead milling, or otherwise prepared as a separate dispersion of sensitizer and binder material. The pigment is usually dispersed in water, which may include some binder, before use. The dispersed pigment, together with paraffin wax, if used, and any other ingredients are mixed with the dispersions of the chromogenic material and the coreactant, together with additional binder if desired, to give the final thermally-sensitive composition for coating on to the support.

The coating technique used for applying the thermally sensitive composition to the support can be any of those conventional in the art, for example, blade coating, air-knife coating or bar or rod coating, for example Meyer bar coating. After the coating has been applied, the product may be calendered or super calendered in conventional manner.

The invention will now be illustrated by the following Examples, in which all parts or percentages are by dry weight unless otherwise stated.

Example 1

A thermally-sensitive composition was made up by the following procedure:

1) 13 dry parts of polyvinyl alcohol were bead milled with 86 dry parts of 3-dialkylamino-6-methyl-7 anilino fluoran chromogenic material in a 37% solids content aqueous dispersion also containing conventional minor amounts of surfactant and defoamer.

2) In a separate procedure, 1.6 dry parts of polyvinyl alcohol (degree of hydrolyzation 87–89%) 18 dry parts of "Scripset 720" amide ammonium salt of non-esterified styrene/maleic anhydride copolymer (hereafter referred to as "AASSMAC"), 14 dry parts stearamide wax, 23 dry parts of aluminum hydroxide filler, 28 dry parts of AP-5 coreactant and 14 dry parts of zinc stearate were bead milled in a 29% aqueous dispersion also containing conventional minor amounts of surfactant and defoamer.

3)The milled dispersions from (1) and (2) above were mixed with each other and with an aqueous calcium carbonate dispersion and additional AASSMAC to form a 26% solids content thermally-sensitive composition of which the approximate percentage dry composition was as follows:

| | |
|---|---|
| Chromogenic material | 7 |
| Polyvinyl alcohol | 2 |
| AASSMAC | 12 |
| Coreactant (AP-5) | 16 |
| Calcium carbonate | 35 |
| Aluminium hydroxide | 13 |
| Stearamide wax | 7 |
| Zinc stearate | 7 |
| Other ingredients (as mentioned above) | 1 |
| | 100 |

It will be noted that the AASSMAC made up 86% of the total weight of binder (i.e. AASSMAC plus polyvinyl alcohol).

This composition was applied to conventional thermal base paper by means of a pilot-scale air knife coater at a target dry coatweight of 6–8 g $m^{-2}$.

The resulting paper was then tested to assess its hot water resistance by means of the following test procedure designed to simulate in an accelerated and extreme form the conditions which the paper might have to withstand in commercial use.

In each case, the tests were conducted only after allowing the coating time to cure fully (3 days is normally sufficient for this).

The test involved moistening the test sample with warm water on both its coated and uncoated surfaces and then sandwiching the moistened sample between glass microscope slides. A 15 kg weight was then positioned carefully on the top slide and the whole assembly was then kept in an oven for 3 hours at 60° C. The weight was then removed, and the microscope slides were carefully separated and the extent to which the coating stuck to the slide with which it was in contact was determined. Satisfactory hot water resistance is indicated by the absence of sticking (ignoring any material adhering only to the edge portions of the slide).

The sample paper prepared as just described showed no significant sticking in this test, and so was judged to have excellent hot water resistance. A conventional commercially available thermally-sensitive label paper utilizing polyvinyl alcohol hardened With glyoxal as the binder and a commercially available barrier topcoated thermally-sensitive label paper were also tested by way of comparison. The topcoated product was found to exhibit no sticking, but the coating of the comparison non-topcoated product was found to have all come off the paper on to the slide. It can be concluded therefore that the non-topcoated paper according to the invention matched the performance of the topcoated product and was much superior to the conventional non-topcoated product.

Example 2

This illustrates the possibility of using a smaller proportion of AASSMAC relative to polyvinyl alcohol when the polyvinyl alcohol includes a proportion of material of a higher degree of hydrolyzation than that used in Example 1, together with a hardener (glyoxal).

Thermally-sensitive compositions were made up by the following general procedure:

1) A chromogenic material grind was made up by bead milling 13 dry parts of polyvinyl alcohol with 87 dry parts of chromogenic material, both as used in Example 1, in a 45% aqueous dispersion also containing conventional minor amounts of surfactant and defoamer.

2) A coreactant grind was made up by bead milling 5.3 dry parts of polyvinyl alcohol as used in Example 1 with 94 parts of AP-5 in a 40% solids content aqueous dispersion also containing conventional minor amounts of surfactant and defoamer.

3) A wax dispersion was made up by bead milling 2.9 dry parts of stearamide wax with 1.9 dry parts of zinc stearate and 1.2 dry parts of AASSMAC in a 30% solids content aqueous dispersion.

4) The milled dispersions from (1), (2) and (3) above were mixed with each other and with an aqueous calcium carbonate dispersion and additional binder, and the mixture was adjusted to 25.5% solids content. This procedure was carried out twice. In the first case (Variant A), the binder was AASSMAC and in the second case (Variant B), the binder was a blend of equal weight proportions of AASSMAC and polyvinyl alcohol (98% hydrolyzed), with 15% glyoxal hardener also present, based on the amount of polyvinyl alcohol used. A third composition (Variant C) was then made up by blending Variants A and B in equal weight proportions. The approximate percentage dry composition of the various compositions was as follows:

| | A | B | C |
|---|---|---|---|
| Chromogenic Material | 7 | 7 | 7 |
| Coreactant Material | 15 | 15 | 15 |
| AASSMAC | 10 | 6 | 8 |
| Polyvinyl alcohol | 2 | 6 | 4 |
| Calcium carbonate | 53 | 52 | 53 |
| Stearamide wax | 7 | 7 | 7 |
| Zinc stearate | 5 | 5 | 5 |
| Other ingredients | 1 | 2 | 1 |
| | 100 | 100 | 100 |

The AASSMAC made up 83% of the total weight of binder (i.e. AASSMAC plus polyvinyl alcohol) in Variant A, 41% in Variant B and 64% in Variant C.

The various formulations were then laboratory coated on to base paper, dried, allowed to stand for 3 weeks and then subjected to water resistance testing as described in Example 1. It was found that. Variants A and C were satisfactory (with Variant A being slightly more hot water resistant than Variant C) but that Variant B had poor water resistance, demonstrating that insufficient AASSMAC was present.

Example 3

This illustrates the use of a range of different wax and binder levels.

6.3 dry parts of coreactant grind and 3.2 dry parts of chromogenic material grind, both as used in Example 2, were bead milled with 10.3 dry parts of AASSMAC, 53 dry parts of calcium carbonate, 7.4 dry parts of stearamide wax and 4.9 dry parts of zinc stearate in a 26% solids content aqueous dispersion to give Formulation 1.

The approximate percentage dry composition of Formulation 1 was as follows:

| | |
|---|---|
| Chromogenic material | 7 |
| Coreactant material | 15 |
| AASSMAC | 10 |
| Polyvinyl alcohol | 2 |
| Calcium carbonate | 53 |
| Stearamide wax | 7 |
| Zinc stearate | 5 |

-continued

| | |
|---|---|
| Other ingredients | 1 |
| | 100 |

The AASSMAC made up 84% of the total weight of binder (i.e. AASSMAC plus polyvinyl alcohol)

The above procedure was then repeated but using three times the quantity of AASSMAC to give Formulation 2. In this Formulation, AASSMAC made up 94% by weight of the total weight of binder.

Formulations 3 and 4 were then made up following the same general procedure as for Formulation 1 but with the stearamide wax content reduced respectively to 3% and 1.5% (dry) and additional zinc stearate being added as a weight replacement for the omitted stearamide wax. The various formulations were then laboratory coated, dried and tested for hot water resistance as described in Example 2, and also for thermal printing behavior. It was found that although the thermal response characteristics of the papers varied markedly according to the amount of stearamide wax present, there was little affect on the hot water resistance, which was satisfactory in every case.

Example 4

This illustrates the use of thermally-sensitive formulations with a pigment blend of silica and calcium carbonate rather than the calcium carbonate and/or aluminum hydroxide of previous Examples.

Chromogenic material and coreactant material grinds were made up as described in Example 2. These were then mixed with each other and bead milled with stearamide wax, zinc stearate, AASSMAC, silica and calcium carbonate in an aqueous dispersion at 26% solids content. The approximate percentage dry composition of the final formulation was as follows:

| | |
|---|---|
| Chromogenic material | 7 |
| Polyvinyl alcohol | 2 |
| AASSMAC | 12 |
| Coreactant (AP5) | 12 |
| Stearamide wax | 9 |
| Zinc stearate | 11 |
| Silica | 20 |
| Calcium carbonate | 27 |
| Other | — |
| | 100 |

The resulting formulation was laboratory coated on to paper, dried, and tested for hot water resistance as described in previous Examples.

The above procedure was then repeated but with additional polyvinyl alcohol (as used in the chromogenic material and coreactant material grinds) replacing the AASSMAC.

The AASSMAC-containing formulation had good hot water resistance, whereas,the comparison formulation had no hot water resistance.

Example 5

This illustrates the use of a thermally-sensitive formulation containing p-benzylbiphenyl as a sensitizer as a weight for weight replacement for the stearamide wax used in Example 4. The procedure was as in Example 4, and the resulting product was found to have good water resistance.

Example 6

The procedure of Example 1 was repeated, but using a range of different chromogenic material and coreactant combinations and somewhat higher solids contents in each of the steps (1) to (3) than in Example 1. Four different combinations were used, as follows:

| Run No. | Chromogenic Materials | Coreactant Materials |
|---|---|---|
| A | ODB-2 | AP-5 |
| B | N-102/ODB-2 | AP-5 |
| C | ODB-2 | Bisphenol A |
| D | ODB-2 | D8 |

All of the samples gave satisfactory thermal imaging properties and satisfactory water resistance (i.e. no sticking) when subjected to hot water testing as described in Example 1. Since the Example 1 papers performed better than a conventional control sample in the hot water resistance tests, it can be concluded that the papers of this Example are also superior to the conventional control paper.

I claim:

1. Thermally-sensitive record material comprising a support and a thermally-sensitive composition coated on the support, the thermally-sensitive composition including as image forming components an electron donating chromogenic material and complementary electron accepting coreactant material effective to develop the color of the chromogenic material when heat is applied to the composition, said image forming components being dispersed in a thermographically acceptable binder formulation, characterized in that the binder formulation comprises a major proportion of an amide ammonium salt of a substantially non-esterified styrene/maleic anhydride copolymer and a minor proportion of polyvinyl alcohol.

2. A method for improving the water resistance of a thermally sensitive record material including as image-forming components an electron donating chromogenic material and complementary electron accepting coreactant material effective to develop the color of the chromogenic material when heat is applied to the composition, and a binder formulation for said components, said process comprising selecting a binder formulation for said components comprising a major proportion of an amide ammonium salt of a substantially non-esterified styrene/maleic anhydride copolymer and a minor proportion of polyvinyl alcohol.

3. A method according to claim 2, wherein the water resistance is warm water resistance.

* * * * *